US005666975A

United States Patent [19]

Lord

[11] Patent Number: 5,666,975

[45] Date of Patent: Sep. 16, 1997

[54] METHOD OF FABRICATING CIGARETTES IN A DISPENSING-TYPE MACHINE OPERATED BY A USER PERSON

[76] Inventor: Gilbert Lord, 6555 Metropolitan Boulevard East, Suite Jardin 2, Montreal, Quebec, Canada, H1P 3H3

[21] Appl. No.: 260,973

[22] Filed: Jun. 15, 1994

[51] Int. Cl.[6] ..... A24C 5/42

[52] U.S. Cl. ..... 131/70; 131/74; 131/75; 131/108

[58] Field of Search ..... 131/70, 74, 109.1, 131/108

[56] References Cited

U.S. PATENT DOCUMENTS

| | | | |
|---|---|---|---|
| 3,892,245 | 7/1975 | Asbill | 131/70 |
| 4,572,216 | 2/1986 | Josuttes et al. | 131/70 |

FOREIGN PATENT DOCUMENTS

| | | | |
|---|---|---|---|
| 898922 | 8/1984 | Belgium | 131/70 |
| 0 144 060 | 6/1985 | European Pat. Off. | 131/70 |
| 28 11 432 | 9/1978 | Germany | 131/70 |
| 87 11 945 | 2/1988 | Germany | 131/70 |

OTHER PUBLICATIONS

Seragnoli—Cigarette Manufacturing Machine, Feb. 16, 1985.

Lorenzen—Tobacco Distribution for Sigeratte Rod.

*Primary Examiner*—V. Millin

*Assistant Examiner*—Charles W. Anderson

[57] ABSTRACT

A method of fabricating cigarettes through a dispensing-type machine and from a predetermined quantity of tobacco leaves selected by a user person. The method comprises storing predetermined quantities of tobacco leaves in hermetically sealed bags wherein the tobacco leaves are prevented from drying out. One or more bags are selected by the user person and inserted, one at a time, in a receiving opening of the machine. The machine cuts the tobacco leaves and provides a predetermined quantity of fine-cut tobacco. The fine-cut tobacco is transferred to a tubing station where the fine-cut tobacco is automatically disposed in cigarette tubes to form cigarettes which are ejected or dispensed for reception by the user.

13 Claims, 1 Drawing Sheet

METHOD OF FABRICATING CIGARETTES IN A DISPENSING-TYPE MACHINE OPERATED BY A USER PERSON

TECHNICAL FIELD

The present invention relates to a method of fabricating cigarettes in a dispensing-type machine, and which is operable by a user person whereby the user can select a particular type of tobacco leaves or flakes packaged in a predetermined quantity, and insert these leaves or flakes in a machine which will immediately produce cigarettes and dispensed to the user in bulk form.

BACKGROUND ART

It is known to fabricate cigarettes by the use of hand-operable devices which permit the insertion of tobacco in bulk or plug form into cigarette tubes. An example of such device is disclosed in Canadian Patent 1,271,389. These devices are for domestic use and permits a person to produce cigarettes in a more economical fashion. These types of devices and machines have been known for several decades, but with the majority of these devices only a single cigarette can be produced at a time and the production thereof is labor intensive. Dispensing machines are also known to dispense packages of cigarettes preselected by the user. However, the cigarettes are pre-packaged and such cigarettes are even more expensive than those conventionally bought over the counter.

There is a need, however, to provide a novel concept and method as well as a machine to automatically produce cigarettes in predetermined quantities, and quickly from bulk tobacco leaves or flakes which are preselected by a user.

SUMMARY OF INVENTION

A feature of the present invention is to provide such a method and machine to serve a need which has heretofore not been provided by the prior art discussed hereinabove.

Another feature of the present invention is to provide a method of fabricating cigarettes through a dispensing-type machine and from a predetermined quantity of tobacco leaves or flakes selected by a user person. The method comprises storing predetermined quantities of tobacco leaves or flakes in storage means wherein the tobacco leaves or flakes are prevented from drying out, and in a hermetically protected fashion to retain a certain percentage of humidity in the leaves or flakes.

Another feature of the present invention is to provide a method of fabricating cigarettes in a dispensing-type machine and from a predetermined quantity of tobacco leaves or flakes selected by a user person, wherein the machine is solely operated by the user and comprises a cutting station to produce fine-cut tobacco from the leaves or flakes, and a tubing station to pack the fine-cut tobacco into cigarette tubes which are then dispensed to the user.

Another feature of the present invention is to provide a novel method of fabricating cigarettes in a dispensing-type machine which can be conveniently mounted in small convenient stores and other larger type merchandising stores, and which machine is easy to use and easy to service.

According to the above features, from a broad aspect, the present invention provides a method of fabricating cigarettes in a dispensing-type machine and from a predetermined quantity of tobacco leaves or flakes selected by a user person. The method comprises storing predetermined quantities of tobacco leaves or flakes in storage means wherein the tobacco leaves or flakes are prevented from drying out. One or more of the predetermined quantities of tobacco leaves or flakes are selected and inserted in a receiving opening of the machine. The tobacco leaves or flakes placed in the opening are cut by the machine to produce a predetermined quantity of fine-cut tobacco. The fine-cut tobacco is transferred to a tubing station where the fine-cut tobacco is automatically disposed in cigarette tubes to form cigarettes which are dispensed for reception by the user.

BRIEF DESCRIPTION OF DRAWINGS

A preferred embodiment of the present invention will now be described with reference to the drawings in which.

DESCRIPTION OF PREFERRED EMBODIMENTS

Figure 1:
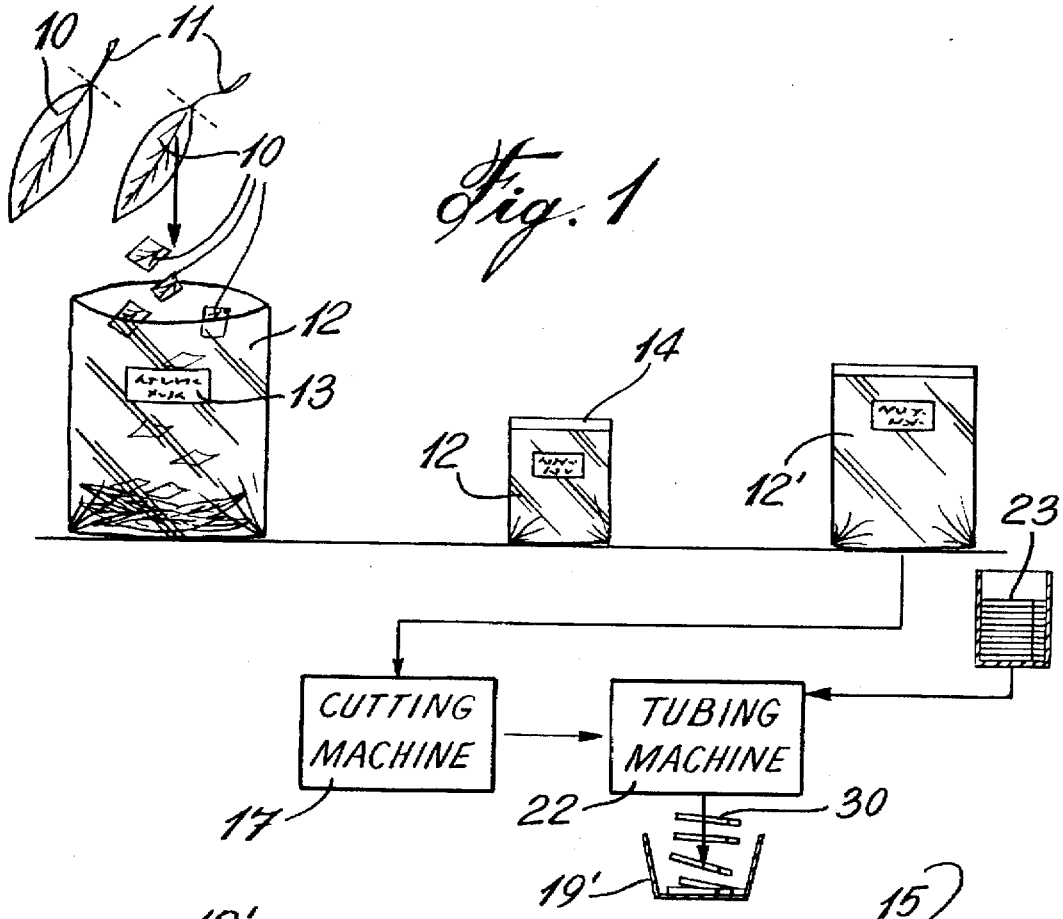
FIG. 1 is a flow diagram showing the process of producing cigarettes in accordance with the present invention.

Referring now to the drawings, and more particularly to FIG. 1, there is shown some of the steps in the process of the present invention for the fabrication of cigarettes. The cigarettes are manufactured starting from tobacco leaves or flakes 10 of which the stems 11 are cut prior to the placement thereof, in predetermined quantities, in bags 12. The bags 12 may be transparent or non-transparent and carry printed matter 13 thereon to identify the type of tobacco leaves placed therein. The tobacco could also be stored differently in sealed containers.

The bags 12 are then sealed at 14 to provide hermetically sealed bags to retain humidity in the tobacco leaves. These bags 12 may be provided in different sizes, such as bags 12 and 12', to hold predetermined quantities of tobacco cuttings, herein 20 g or 200 g-packages to fabricate two or twenty cigarettes.

Figure 2:
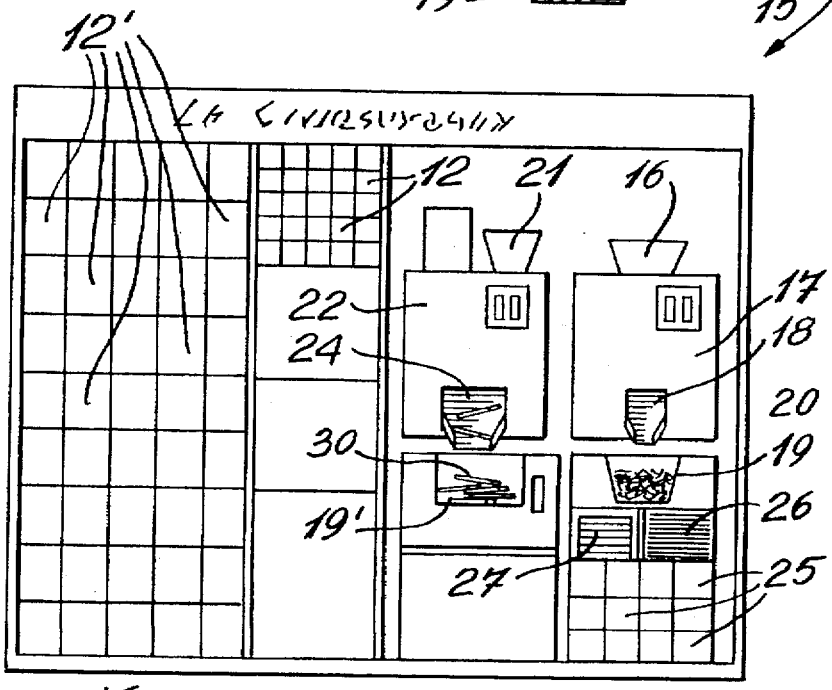
FIG. 2 is a front view showing a display unit incorporating therein a typical example of the manner in which the machine to carry out the method of the present invention may be provided for ease of use by an end user.

With additional reference to FIG. 2, it can be seen that these bags are conveniently stored in a display cabinet 15 for selection by an end user. The user selects the type of tobacco that he wishes and the size of the bag depending on the quantity of cigarettes that he also desires to obtain. He opens the bag and inserts the tobacco cuttings into the receiving chute or receiving opening 16 of a tobacco cutting machine 17 where the tobacco is cut or slit by cutting means (not shown), for example reciprocating blades disposed in a predetermined manner, to provide fine-cut tobacco. The fine-cut tobacco is then discharged, as it is slit, through a discharge opening 18 and received in a receptacle 19 placed adjacent the opening 18 by the user.

The user then transfers the fine-cut tobacco 20 contained within the container 19 into the receiving chute or opening 21 of a tubing machine 22. The tubing machine processes the fine-cut tobacco and inserts same into a predetermined number of cigarette tubes 23 which are loaded into the tubing machine by the end user or by another person who services the machine. Preferably, the tubing machine holds a large quantity of these cigarette tubes. The machine inserts a predetermined quantity of this tobacco within the tube and simultaneously discharges them through a discharge gate 24 where the cigarettes are collected within the receptacle or bag 19' placed thereunder by the user. Alternatively, the machine may dispense all of the cigarettes into a receiving compartment which is visible to the user, provided at the base of the machine, so that when all the cigarettes have been dispensed the user merely opens the compartment by opening a door or other obvious means and removes the cigarettes.

The display case 15 is also fabricated to contain supplies of cigarette tubes disposed in boxes 25 as well as supplies of bags 26 or cigarette packages 27 in which the bulk cigarettes that are dispensed from the tubing machine may be placed by the user person.

It is pointed out that with this type of method of fabrication of cigarettes the cost for producing cigarettes can be greatly reduced. The machine can also be fully automated whereby the fine-cut tobacco produced by the cutting machine is automatically fed to a tubing station within a single machine housing so that the user only needs to place the tobacco leaves or flakes within the receiving chute 16 and collects the manufactured cigarettes 30 in an outlet recipient or compartment. The machine should be capable of producing cigarettes at a speed of about one cigarette per second.

It is within the ambit of the present invention to cover any other obvious modifications of the present invention, provided such modifications fall within the scope of the appended claims.

I claim:

1. A method of fabricating cigarettes through a dispensing-type machine and from a predetermined quantity of tobacco leaves of flakes selected by a user person from said dispensing machine, said method comprising the steps of:

(i) dispensing in a display case of said dispensing machine different types of tobacco leaves or flakes stored in hermetically sealed containment means to prevent said tobacco leaves from drying, and providing an identification means for selection of one or more of said containment means by a user person (ii) selecting one or more of said predetermined quantities of tobacco leaves or flakes;

(iii) inserting said selected one or more predetermined quantities of tobacco leaves or flakes in a receiving opening of said machine;

(iv) cutting said tobacco leaves or flakes placed in said opening to produce a predetermined quantity of fine-cut tobacco;

(v) transferring said fine-cut tobacco to a tubing station where said fine-cut tobacco is automatically disposed in cigarette tubes to form cigarettes; and (vi) dispensing said cigarettes for reception by said user.

2. A method as claimed in claim 1 wherein after step (iv) there is further provided the step of dispensing said fine-cut tobacco for reception in containment means for reception by said user.

3. A method as claimed in claim 2 wherein said step (v) comprises manually transferring said fine-cut tobacco to a tubing machine to produce said cigarettes.

4. A method as claimed in claim 3 wherein before said step (vi) there is provided the step of placing a receptacle at a dispensing outlet of said tubing machine to receive said cigarettes.

5. A method as claimed in claim 4 wherein there is further provided the step of placing said cigarettes received in said receptacle in a cigarette package container.

6. A method as claimed in claim 1 wherein prior to step (i) there is comprised the steps of removing the stems from tobacco leaves to be placed in said storage means.

7. A method as claimed in claim 1 wherein said step (v) comprises automatically conveying said fine-cut tobacco to said tubing station.

8. A method as claimed in claim 1 wherein there is further provided the step of loading a predetermined quantity of cigarette tubes in said dispensing-type machine.

9. A method as claimed in claim 1 wherein said tobacco leaves or flakes have a certain percentage of humidity therein, and further wherein different quantities of said tobacco leaves or flakes are placed in bags of different sizes for the fabrication of different quantities of cigarettes by said machine.

10. A dispensing-type cigarette making machine comprising a display cabinet having a plurality of storage means for displaying hermetically sealed containment means each containing a predetermined quantity of tobacco leaves or flakes, there being different types of leaves or flakes and identification means to identify such different types for selection by a user person, a tobacco cutting and tubing machine in said display cabinet and having a receiving opening in which a selected quantity of said tobacco leaves or flakes are inserted; said machine, when activated by said use person, cutting said tobacco leaves or flakes to provide fine-cut tobacco; transfer means to transfer said fine-cut tobacco to a receiving means of a tubing machine in said display cabinet, said tubing machine capable of holding a predetermined quantity of hollow cigarette tubes and filling said tubes with a predetermined quantity of fine-cut tobacco, and a discharge gate for said user person to collect said cigarette tubes filled with said fine-cut tobacco.

11. A machine as claimed in claim 10 wherein there is further provided storage means in said display cabinet for storing predetermined supplies of cigarette tubes for selection by a user person.

12. A machine as claimed in claim 10 wherein said means to transfer is a receptacle which is transferable to said receiving means by said user person.

13. A machine as claimed in claim 10 wherein said fine-cut tobacco is discharged from an opening in said machine for transportation by said user person to said receiving means.

* * * * *